US011111779B2

(12) United States Patent
Inglis et al.

(10) Patent No.: US 11,111,779 B2
(45) Date of Patent: Sep. 7, 2021

(54) MAGNETIC POSITION INDICATOR

(71) Applicant: Halliburton Energy Services, Inc., Houston, TX (US)

(72) Inventors: Peter D W Inglis, Dundee (GB); Katherine Ann Davies, Carnoustie (GB); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 126 days.

(21) Appl. No.: 16/528,117

(22) Filed: Jul. 31, 2019

(65) Prior Publication Data

US 2021/0032983 A1 Feb. 4, 2021

(51) Int. Cl.
*E21B 47/092* (2012.01)
*E21B 23/00* (2006.01)
(Continued)

(52) U.S. Cl.
CPC ..... *E21B 47/092* (2020.05); *E21B 23/004* (2013.01); *E21B 34/06* (2013.01); *E21B 2200/04* (2020.05)

(58) Field of Classification Search
CPC ..... E21B 23/004; E21B 23/042; E21B 23/04; E21B 23/006; E21B 34/10; E21B 34/14;
(Continued)

(56) References Cited

U.S. PATENT DOCUMENTS 4,808,925 A 2/1989 Baird
5,666,050 A * 9/1997 Bouldin ..... G01B 7/003 324/207.26
(Continued)

FOREIGN PATENT DOCUMENTS

CN 106285505 1/2017
EP 1998002 A2 * 12/2008 ..... E21B 47/092
(Continued)

OTHER PUBLICATIONS

PCT/US2019/044488 , "International Search Report and Written Opinion", dated Apr. 28, 2020, 11 pages.

*Primary Examiner* — Jennifer H Gay
(74) *Attorney, Agent, or Firm* — Kilpatrick Townsend & Stockton LLP

(57) ABSTRACT

A downhole tool having an indexing apparatus for actuating the downhole tool from the surface by applying a predetermined number of hydraulic pressure signals to the downhole tool. The downhole having an outer tubing that has an outer surface and an inner surface, the inner surface defining an inner region of the outer tubing. The downhole tool includes a sliding sleeve positioned within the inner region of the outer tubing, the sliding sleeve being slideable relative to the outer tubing. The sliding sleeve including a first magnet and a second magnet that are positioned in an opposing orientation relative to one another for providing a reference point detectable via a magnetometer at a surface of a wellbore. An indexing position of the downhole tool being determined by comparing a location of the reference point on the sliding sleeve to a location of a fixed point on the outer tubing.

20 Claims, 7 Drawing Sheets

(51) Int. Cl.
*E21B 34/08* (2006.01)
*E21B 34/06* (2006.01)

(58) Field of Classification Search
CPC ..... E21B 47/092; E21B 2200/04; E21B 2200/06; E21B 2034/002; E21B 2034/007
See application file for complete search history.

(56) References Cited

U.S. PATENT DOCUMENTS 6,509,732 B1 * 1/2003 Rhodes ..... G01B 7/003 324/207.12
7,416,029 B2 * 8/2008 Telfer ..... E21B 21/103 166/386
8,056,643 B2 * 11/2011 Basmajian ..... E21B 34/14 166/386
8,129,984 B2 * 3/2012 Hosek ..... G01B 7/003 324/207.24
8,776,890 B2 * 7/2014 Basmajian ..... E21B 34/10 166/334.1
9,038,747 B2 * 5/2015 Abney ..... E21B 7/04 175/61
9,068,425 B2 * 6/2015 Williamson, Jr. ..... E21B 34/06
9,797,238 B2 * 10/2017 Frosell ..... G01V 3/081
9,920,621 B2 3/2018 Frosell et al.
10,174,589 B2 * 1/2019 Vick, Jr. ..... E21B 34/10
10,472,929 B2 * 11/2019 Miller ..... E21B 23/006
10,655,431 B2 * 5/2020 Gonzalez ..... E21B 34/10
10,738,570 B2 * 8/2020 Miller ..... E21B 23/006
2006/0243455 A1 * 11/2006 Telfer ..... E21B 34/14 166/386
2007/0289734 A1 * 12/2007 McDonald ..... E21B 34/06 166/66.5
2008/0236819 A1 * 10/2008 Foster ..... E21B 33/128 166/255.2
2008/0294344 A1 * 11/2008 Sugiura ..... E21B 47/024 702/6
2009/0128141 A1 * 5/2009 Hopmann ..... E21B 47/092 324/207.24
2009/0242199 A1 * 10/2009 Basmajian ..... E21B 23/00 166/255.2
2012/0018170 A1 * 1/2012 Basmajian ..... E21B 23/00 166/374
2012/0118582 A1 * 5/2012 Soni ..... E21B 34/14 166/374
2013/0105149 A1 * 5/2013 Williamson, Jr. ..... E21B 34/14 166/250.01
2013/0126154 A1 * 5/2013 Williamson, Jr. .... E21B 34/066 166/65.1
2013/0153297 A1 * 6/2013 Abney ..... E21B 7/067 175/45
2013/0240212 A1 * 9/2013 Basmajian ..... E21B 34/10 166/320
2014/0158433 A1 * 6/2014 Bisset ..... E21B 34/08 175/218
2015/0267478 A1 * 9/2015 Abney ..... E21B 7/04 175/320
2016/0047228 A1 * 2/2016 Frosell ..... G01V 3/38 324/326
2016/0265309 A1 * 9/2016 Vick, Jr. ..... F16K 31/1221
2017/0234105 A1 * 8/2017 Vasques ..... E21B 43/14 166/250.01
2018/0209246 A1 * 7/2018 Miller ..... E21B 23/006
2018/0298726 A1 * 10/2018 Mailand ..... E21B 34/10
2018/0328145 A1 * 11/2018 Gonzalez ..... E21B 34/063
2019/0136685 A1 5/2019 Adetola et al.
2019/0170269 A1 * 6/2019 Oulton ..... E21B 34/06
2019/0376368 A1 * 12/2019 Miller ..... E21B 34/10
2020/0048986 A1 * 2/2020 Knight ..... E21B 34/06
2021/0032983 A1 * 2/2021 Inglis ..... E21B 23/004
2021/0115759 A1 * 4/2021 Ng ..... E21B 34/12

FOREIGN PATENT DOCUMENTS

GB 2561606 A * 10/2018 ..... E21B 34/06
WO WO-2012177781 A2 * 12/2012 ..... E21B 7/067
WO WO-2015094168 A1 * 6/2015 ..... F16K 31/1221
WO WO-2015102622 A1 * 7/2015 ..... G01V 3/081
WO WO-2016020523 A2 * 2/2016 ..... E21B 34/06
WO WO-2017105341 A1 * 6/2017 ..... E21B 34/10
WO WO-2017155550 A1 * 9/2017 ..... E21B 33/12
WO WO-2017200523 A1 * 11/2017 ..... E21B 47/14

* cited by examiner

MAGNETIC POSITION INDICATOR

TECHNICAL FIELD

The present disclosure relates generally to downhole tools positionable in a well system, and more specifically, though not exclusively, to downhole tools including a wellbore isolation tool that utilizes indexing cycles for actuation of the downhole tool.

BACKGROUND

A well system (e.g., oil or gas wells for extracting fluids from a subterranean formation) may include tools positioned downhole. These downhole tools may be actuated from the surface using an indexing apparatus of the downhole tool. Downhole tools can include, but are not limited to, flow control devices, completion isolation valves, fluid loss valves, and circulating subs.

DETAILED DESCRIPTION

Figure 1:
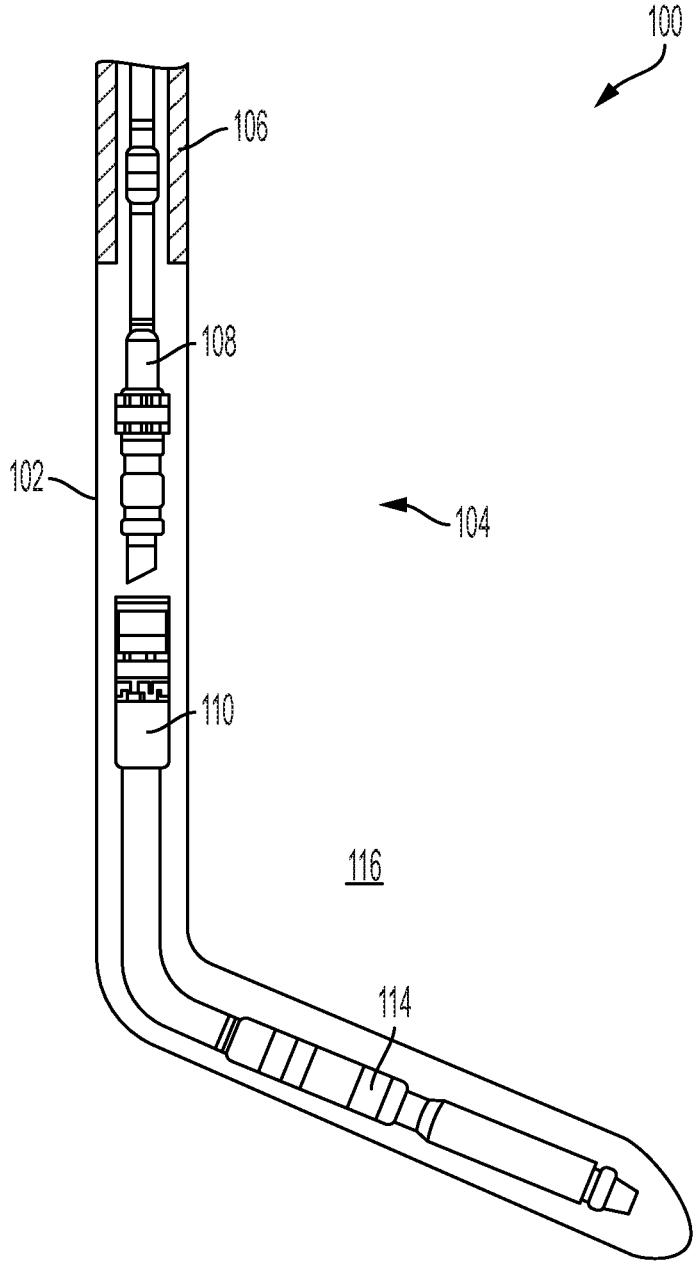
FIG. 1 is a schematic illustration of a well system including a downhole tool according to an aspect of the present disclosure.

Certain aspects and examples of the disclosure relate to a downhole tool that may be actuated from a surface of a wellbore. In some aspects, the downhole tool may include a device (e.g. a flow control device, a completion isolation valve, fluid loss valve, or a circulating sub) that is actuated between an open and a closed position. The downhole tool may be actuated from a surface of the wellbore by applying a pre-determined number of indexing (mechanical or hydraulic) cycles to the downhole tool. Once the predetermined number of indexing cycles is applied, the downhole tool actuates, (e.g. the device may be forced into an open position or a closed position).

The downhole tool may include an outer tubing and a sliding sleeve positioned within an inner region of the outer tubing. The sliding sleeve may move in response to an application of a pressure from the surface. Following a predetermined number of indexing cycles (e.g. pressure applications from the surface), the sliding sleeve may move a sufficient distance to actuate the downhole tool (e.g. to cause a valve in the downhole tool to open or to close).

The downhole tool may be pressure tested during manufacturing to ensure the device properly actuates in response to the application of the pre-determined number of indexing cycles. After testing, the downhole tool may be shipped to a well or rig site for installation. At the well or rig site the downhole tool may be believed to be in an initial indexing position corresponding to a position in which the pre-determined number of indexing cycles are remaining to actuate the downhole tool. Damage to the well system may occur if the downhole tool is in another indexing position corresponding to a fewer number of indexing cycles remaining until actuation. For example, if it is believed the downhole tool is in an initial indexing position corresponding to ten (10) indexing cycles to be cycled through before actuation of the downhole tool, but in fact the sliding sleeve or other features of the downhole tool have shifted (for example, but not limited to, during testing, etc.) such that the downhole tool is in an indexing position in which there are only nine (9) indexing cycles to be cycled through before actuation occurs, the unexpected actuation of the downhole tool after nine indexing cycles may damage the well system. In addition, the unexpected actuation of the downhole tool in such a scenario may injure those working on the well system. Thus, it may be desirable to confirm at the rig or well site, prior to positioning of the downhole tool within the wellbore, the indexing position (i.e. the number of indexing cycles remaining prior to actuation of the downhole tool) of the downhole tool, in particular it may be desirable to confirm that the downhole tool is in the initial indexing position (i.e. that the pre-determined number of indexing cycles remain before actuation of the downhole tool).

The position of the sliding sleeve relative to the outer tubing may correspond to the indexing position of the downhole tool. The position of the sliding sleeve relative to the outer tube may be determined by comparing a location of a reference point on the sliding sleeve to a location of a fixed point on the outer tubing. The distance between the reference point on the sliding sleeve and the fixed point on the outer tubing may correspond to the indexing position of the downhole tool (i.e. the number of indexing cycles remaining prior to actuation of the downhole tool). In some aspects, the reference point on the sliding sleeve may correspond to a mid-point between two magnets positioned in an opposing orientation, i.e. N-S S-N or S-N N-S. The opposing orientation of the magnets may allow for detection of the mid-point between the two magnets using a magnetometer. The mid-point between the two magnets may correspond to a magnetic field of zero in at least one direction. The fixed point on the outer tubing may be a mark or any suitable identification (i.e. a carving, an ink mark, a sticker, an identifiable magnetic field change, an end of the outer tubing, etc.) on the outer tubing.

The distance between the reference point on the sliding sleeve, defined by the mid-point between the two magnets, and the fixed point on the outer tubing may correspond to an indexing cycle of the downhole tool. For example a first distance between the reference point on the sliding sleeve and the fixed point on the outer tubing may correspond to the downhole tool being in an initial position in which the pre-determined number of indexing cycles remains prior to actuation. A second distance may correspond to the downhole tool being in a second position in which a known number of indexing cycles that is either greater than or less than the pre-determined number of indexing cycles remains prior to actuation.

In some aspects, the two magnets may be placed axially relative to one another along a longitudinal axis of the downhole tool. The longitudinal distance between the mid-point of the magnets (i.e. the reference point of the sliding sleeve) and the fixed point of the outer tubing may correspond to an indexing position of the downhole tool. In some aspects, the two magnets may be positioned radially relative to one another about a circumference of the sliding sleeve. The angular offset or radial distance between the reference point on the sliding sleeve and the fixed point on the outer tubing may correspond to a rotational position of the sliding sleeve relative to the outer tubing. The rotational position of the sliding sleeve relative to the outer tubing may correspond to the indexing cycle position of the downhole tool.

At the well site, prior to positioning the downhole tool within the wellbore, the strength and/or direction of a magnetic field of the two magnets may be measured with a magnetometer (e.g., a gauss meter, a hall effect sensor, an inductive pickup coil, a magnetoresistive device such as a GMR chip, or a superconducting quantum interference device ("SQUID")). The magnetometer may measure the scalar magnetic field, or in some aspects the vector magnetic field. The magnetometer may be moved along a length of the downhole tool to measure the magnetic field along the length of the downhole tool for identifying the mid-point between the two magnets positioned on the sliding sleeve. The magnetometer meter may identify the mid-point between the two magnets (i.e. the reference point on the sliding sleeve) by locating the point at which the magnetic field is 0 or at least is a minimum value. The mid-point between the two magnets may correspond to the reference point of the sliding sleeve. The location of the reference point may then be compared to the location of the fixed point on the outer tubing. A distance between the reference point on the sliding sleeve and the fixed point on the outer tubing may correspond to the indexing position of the downhole tool prior to positioning the downhole tool within the wellbore. In some aspects, a linear distance between the reference point and the fixed point on the outer tubing may correspond to the indexing position of the downhole tool. In some aspects, the magnets may be positioned radially along the sliding sleeve such that a rotational distance between a reference point on the sliding sleeve and the fixed point on the outer tubing (i.e. distance measured circumferentially along an outer surface of the outer tubing) may correspond to the indexing position of the downhole tool.

FIG. 1 is a schematic illustration of a well system 100 that includes a bore that is a wellbore 102 extending through various earth strata. The wellbore 102 has a substantially vertical section 104 that may include a casing string 106 cemented at an upper portion of the substantially vertical section 104. The well system 100 may include an upper completion 108 positioned proximate to the casing string 106. The well system 100 may also include a lower completion string 110 positioned below the upper completion 108. A downhole tool 114 may be positioned within the well system 100 below the lower completion string 110. The downhole tool 114 may include a completion isolation valve, a flow control device, a circulating sub, or other suitable devices. In some aspects, the downhole tool 114 may have an open position in which fluid may flow from a surrounding formation 116 through an inner region of the downhole tool 114. In some aspects, the downhole tool 114 may also have a closed position that prevents fluid flow from the surrounding formation 116 through the inner region of the downhole tool 114. In the closed position, the downhole tool 114 may isolate the well system 100 from the surrounding formation 116. For example, the downhole tool 114 in the closed position may isolate the wellbore 102 from the surrounding formation 116 prior to installing the lower completion string 110.

Figure 2:
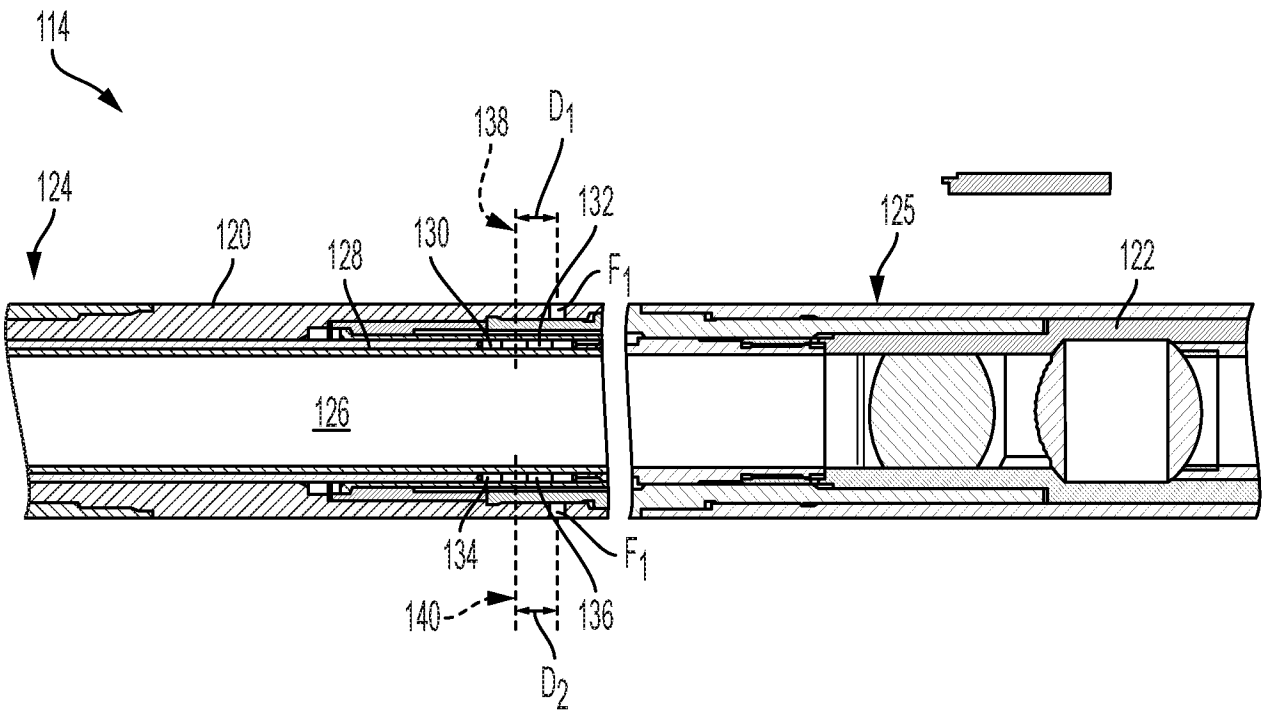
FIG. 2 is a cross-sectional side view of the downhole tool of FIG. 1 according to an aspect of the present disclosure.

FIG. 2 depicts a cross-sectional side view of a portion of the downhole tool 114 according to an aspect of the present disclosure. The downhole tool 114 may be, for example, but not limited to, a flow control device, a completion isolation valve, fluid loss valve, or a circulating sub. The downhole tool 114 may include an outer tubing 120, a device that may be actuated (shown in FIG. 2 as ball valve 122), and an indexing apparatus 124 for controlling the position of the ball valve 122. In FIG. 2 the device is shown as ball valve 122, though in some aspects other suitable devices may be used. In some aspects, the downhole tool 114 may have additional features or elements. The downhole tool 114 may be in the open position when the ball valve 122 is in an open position to permit fluid flow from an outer surface 125 of the outer tubing 120 through an inner region (or inner diameter) 126 of the outer tubing 120. The downhole tool 114 may be in the closed position when the ball valve 122 is in a closed position to prevent fluid flow from the outer surface 125 through the inner region 126 of the outer tubing 120. In the closed position, the downhole tool 114 may isolate the well system from a surrounding formation. For example, the downhole tool 114 in the closed position may isolate the wellbore from the formation prior to installing the lower completion string.

The indexing apparatus 124 of the downhole tool 114 can control the position of the ball valve 122 by opening or closing the ball valve 122 in response to an application of a predetermined number of indexing cycles from the surface of the wellbore. The indexing apparatus 124 may include a sliding sleeve 128 that may move or slide relative to the outer tubing 120. The position of the sliding sleeve 128 relative to the outer tubing 120 may correspond to an indexing position of the downhole tool (i.e. the number of indexing cycles remaining prior to actuation of the downhole tool 114).

A magnet 130 and a magnet 132 may be positioned on the sliding sleeve 128 in an opposing orientation (i.e. with like poles adjacent one another, for example N-S S-N or S-N N-S). The opposing orientation may include both south poles of the magnets being adjacent one another or in the alternative both north poles being adjacent one another. As shown in FIG. 2, in some aspects the magnets 130, 132 may be positioned axially along a longitudinal length of the downhole tool 114. In some aspects, the magnets 130, 132 may be positioned radially or circumferentially on the sliding sleeve 128, for example for determining a rotational position of the sliding sleeve 128 relative to the outer tubing 120. The strength of each of the magnets 130, 132 may vary between aspects of the present disclosure. The magnets 130, 132 may be positioned such that they are touching. In some aspects, the magnets 130, 132 are spaced apart, for example separated by about 0.25 inch (0.635 cm), about 0.5 inch (1.27 cm), about 1 inch (2.54 cm), about 1.5 inches (3.81 cm), about 2 inches (5.08 cm), or any other suitable distance for providing a reference point. In some aspects, the magnets 130, 132 are spaced apart by about 0.5 cm, about 1 cm, about 2 cm, about 2.5 cm, about 3 cm, about 3.5 cm, about 4 cm, about 4.5 cm, or about 5 cm, or any other suitable distance for providing a reference point.

As shown in FIG. 2, in some aspects, additional magnets 134, 136 may be positioned on the sliding sleeve 128. The additional magnets 134, 136 may be positioned on the sliding sleeve 128 in an opposing orientation. The opposing orientation may include both south poles of the magnets being adjacent one another or in the alternative both north poles being adjacent one another. As shown in FIG. 2, in some aspects the additional magnets 134, 136 may be positioned axially along a length of the downhole tool 114. In some aspects, the additional magnets 134, 136 may be positioned radially or circumferentially for determining a rotation of the sliding sleeve 128 relative to the outer tubing 120. The strength of each of the additional magnets 134, 136 may vary between aspects of the present disclosure. The magnets 130, 132, 134, 136 may have differing lengths, diameters, and/or magnetic strengths.

The magnets 130, 132 being in an opposing orientation in which like poles are adjacent one another (e.g., N-S S-N or S-N N-S) may permit accurate detection of a mid-point (or center point) 138 between the centers of the two magnets 130, 132 (i.e., a mid-point between a center of the magnet 130 and a center of the magnet 132). The mid-point 138 may corresponds to a first reference point along the sliding sleeve 128 (hereinafter first reference point or mid-point 138). Similarly, the additional magnets 134, 136 being in an opposing orientation in which like poles are adjacent one another (e.g., N-S S-N or S-N N-S) may permit accurate detection of a mid-point 140 between the center of two magnets 134, 136 that corresponds to a second reference point along the sliding sleeve 128 (hereinafter second reference point or mid-point 140). The first and second reference points 138, 140 may be determined at a surface of the wellbore by passing a magnetometer along the length of the downhole tool 114 along an outer surface of the downhole tool 114. The first and second reference points 138, 140 may correspond to a point where the magnetic field is zero or in some aspects where the absolute value of the magnetic field is a local minimum.

Figure 3:
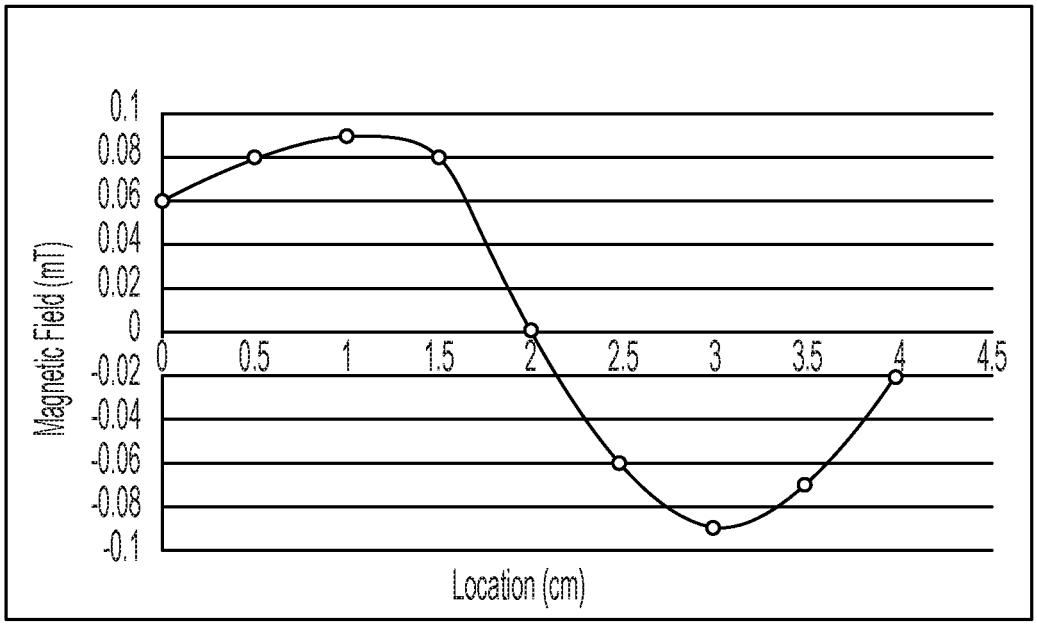
FIG. 3 is a graphical illustration of a magnetic field measured along a length of the downhole tool of FIG. 1 according to an aspect of the present disclosure.

FIG. 3 for example, depicts a graph having an X-axis that corresponds to a location along a length of the downhole tool 114 and a Y-axis that corresponds to a magnetic field measured. FIG. 3 depicts the magnetic field measured using a magnetometer, for example using a gauss meter, as the magnetometer is moved along the length of the downhole tool 114. As shown in the graph, the magnetic field detected as the magnetometer is moved along the length of the downhole tool 114 may change. The location at which the magnetic field detected by the magnetometer crosses the X-axis (shown in FIG. 3 at a magnetic field of zero) may correspond to the mid-point (e.g. mid-points 138, 140) between the two magnets at a specific location along the length of the downhole tool 114. In some aspects, the magnetometer may be inserted into the inner region 126 (or inner diameter) of the downhole tool 114 to identify the mid-points 138, 140.

Referring again to FIG. 2, the sliding sleeve 128 moves relative to the outer tubing 120 during the indexing of the downhole tool 114. The relative position between the sliding sleeve 128 and the outer tubing 120 may correspond to an indexing position of the downhole tool 114. The outer tubing 120 may include a fixed point $F_1$ such that the distance between one or more reference points on the sliding sleeve 128 (e.g., reference points 138, 140, and/or additional reference points) may be determined. For example, a distance $D_1$ along a length of the downhole tool 114 between the first reference point 138 and the fixed point $F_1$ on the outer tubing 120 may correspond to an indexing position of the downhole tool 114. In some aspects, the fixed point $F_1$ may be any suitable identifying feature on the outer tubing 120 (e.g., a mark, a carving, an engraving, a sticker, a change in magnetic field, an end of the outer tubing, or any other suitable identifying feature along the outer tubing). In some aspects, the fixed point $F_1$ may be an identifying feature that at least partially encircles a circumference of the outer tubing 120 (as shown in FIG. 2).

A distance $D_2$ along a length of the downhole tool 114 between the second reference point 140 and the fixed point $F_1$ may also may correspond to an indexing position of the downhole tool 114. The distance $D_1$ and $D_2$ may be the same where the first and second reference points 138 and 140 are positioned at the same linear distance along the sliding sleeve 128. Depending on the position of the downhole tool 114 at the surface, such as the position in which the downhole tool 114 is placed on a ground surface, one of the first or second reference points 138, 140 may be adjacent the ground surface and thus difficult to locate using the magnetometer. By providing multiple pairs of magnets (e.g., magnets 130, 132 and magnets 134, 136), it is more likely that at least one of the pairs of magnets will be located off the ground surface such that the magnetometer may measure the magnetic fields of the magnetics and identify a reference point (e.g., reference points 138, 140). Aspects in which the fixed point $F_1$ at least partially encircles the circumference of the outer tubing 120 can similarly reduce the chances that the fixed point $F_1$ on the outer tubing 120 is positioned adjacent the ground surface. In other words, multiple reference points on the sliding sleeve 128 and a fixed point $F_1$ that at least partially encircles the outer tubing 120 (or in some aspects multiple fixed points on the outer tubing 120 positioned at the same distance along a length of the outer tubing 120) may permit determining a distance between a reference point on the sliding sleeve 128 and a fixed point along the outer tubing 120 regardless of the position of the downhole tool 114 on the ground surface at the well site.

In some aspects more or fewer magnet pairs may be installed on the sliding sleeve 128. Additional magnet pairs may be oriented in an opposing magnetic orientation (e.g. N-S S-N; S-N N-S) or may be oriented in an aligning magnetic orientation (e.g. N-S N-S; S-N S-N). The orientation of the magnet pairs may provide different magnetic field values which may aid in identifying each reference point corresponding to the magnetic pairs along the sliding sleeve 128. Additional magnet pairs could each include different magnetic field strengths or varying orientations (i.e. N-S S-N verses S-N N-S) to distinguish each pair from one another. For example, the mid-point of each magnet pair can correspond to a particular known location or reference point on the sliding sleeve 128 which may be used to determine the indexing position of the downhole tool 114. In some aspects, the magnets installed on the sliding sleeve 128 may be rare earth magnets, for example, but not limited to magnets comprising neodymium-iron-boron or samarium-cobalt. In some aspects, the magnets installed on the sliding sleeve 128 may be ferrite magnets, for example, but not limited to magnets comprising iron oxide and barium carbonate, or iron oxide and strontium carbonate. In still yet other aspects, the magnets installed on the sliding sleeve 128 may be alnico magnets.

Figure 4:
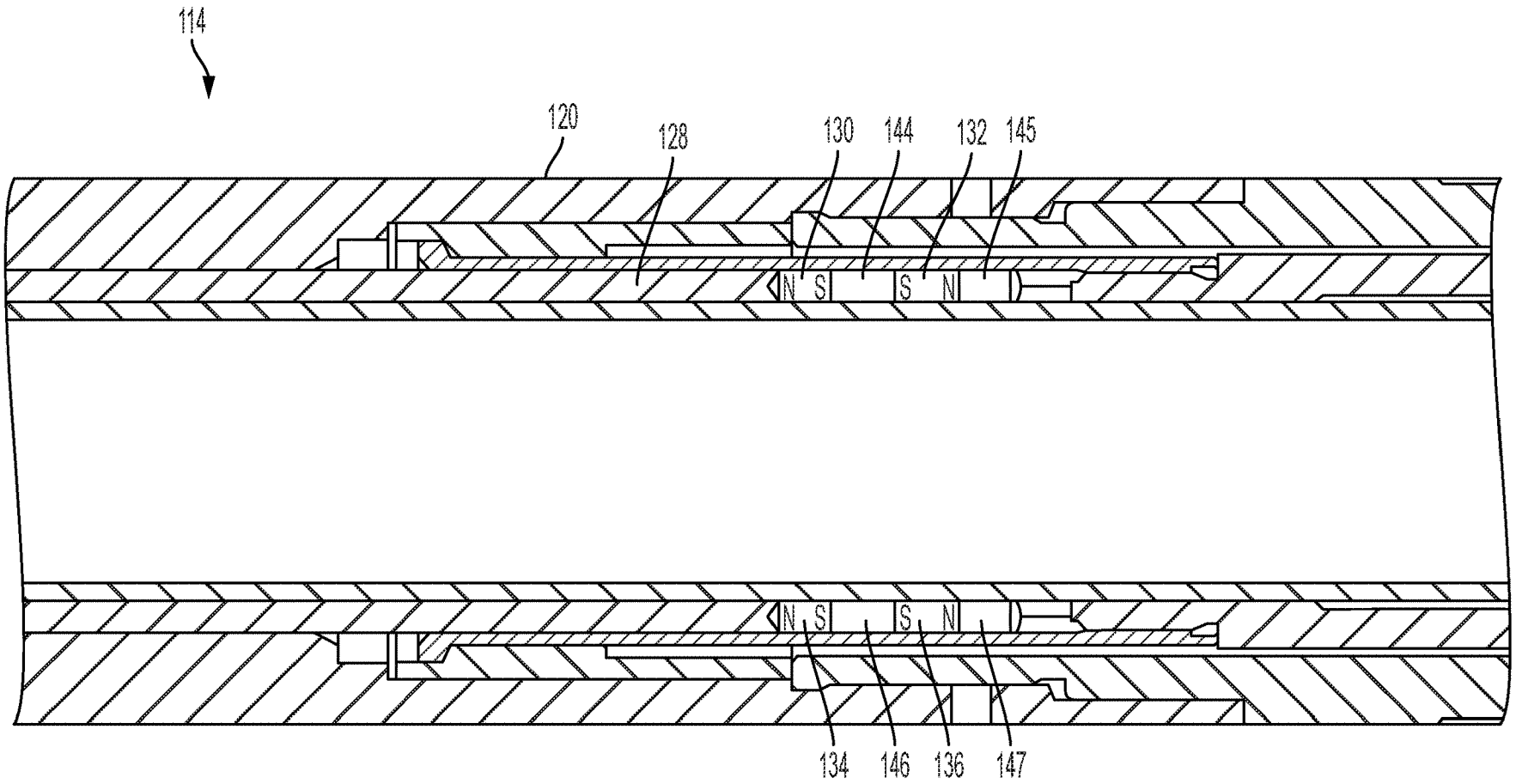
FIG. 4 is a cross-sectional side view of a portion of the downhole tool of FIG. 1 according to an aspect of the present disclosure.

FIG. 4 depicts an enlarged view of a portion of the downhole tool 114 of FIG. 2 including the outer tubing 120, the sliding sleeve 128, and magnets 130, 132 and magnets 134, 136. FIG. 4 depicts the south poles of the magnets 130, 132 being adjacent one another, though in some aspects the north poles of the magnets 130, 132 may be positioned adjacent one another. Similarly, while FIG. 4 depicts the south poles of the magnets 134, 136 being adjacent one another, in some aspects the north poles of the magnets 134, 136 may be positioned adjacent one another. FIG. 4 also depicts the magnets 130, 132 and 134, 136 being separated by optional spacers 144, 146. The optional spacers 144, 146 may be made of ferromagnetic material (e.g. ferromagnetic steel) to enhance the magnetic field strength of the magnets 130, 132, 134, 136. In some aspects, the optional spacers 144, 146 may be made of a polymer (e.g. PTFE plastic) for minimizing the vibration and shock loads experienced by the magnets. In some aspects, the optional spacers 144, 146 may comprise an air gap. In some aspects, more or fewer optional spacers, including no optional spacers, may be used. For example, though in FIG. 4 optional spacer 144 is shown positioned between magnets 130, 132 in some aspects additional optional spacers may be positioned on either end of magnets 130, 132.

Figure 5:
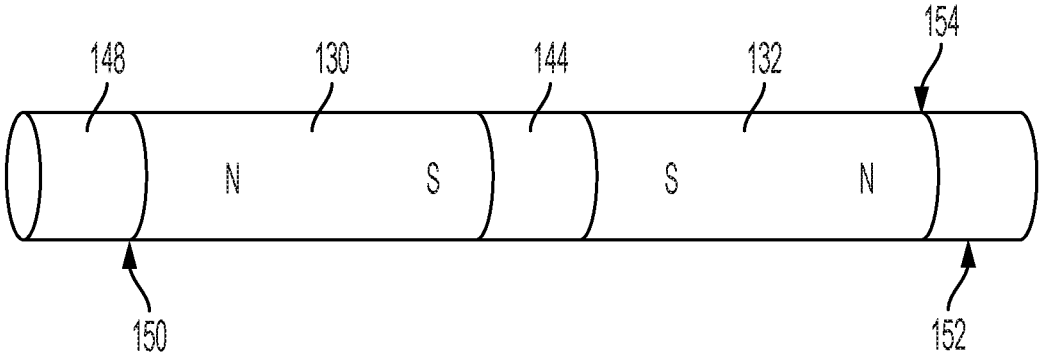
FIG. 5 is a schematic illustration of a pair of magnets in an opposing orientation and multiple spacers according to an aspect of the present disclosure.

FIG. 5, for example depicts an aspect of the present disclosure in which an optional spacer 148 is positioned at an end 150 of the magnet 130, and another optional spacer 152 is positioned at an end 154 of the magnet 132 with the optional spacer 144 positioned between the magnet 130 and the magnet 132. Additional optional spacers may also be included adjacent any additional magnet pairs positioned on the sliding sleeve 128 (e.g. magnets 134, 136).

As shown in FIG. 4, in some aspects a fastening feature 145 may retain the magnets 130 and 132 in position. The fastening feature 145 may be a set screw, adhesive, or other suitable device. Similarly, a fastening feature 147 may retain magnets 134 and 136 in position. The fastening feature 147 may be a set screw, adhesive, or other suitable feature. As shown in FIG. 4, in some aspects magnets 130, 132 may be positioned axially along the length of the sliding sleeve 128 to provide a reference point on the sliding sleeve 128. In aspects in which the magnets 130, 132 are positioned radially or circumferentially around the sliding sleeve 128 may provide a mid-point corresponding to a reference point on the sliding sleeve 128. As the downhole tool 114 indexes through an indexing cycle the sliding sleeve 128, including the reference point on the sliding sleeve, may rotate relative to the outer tubing 120. The rotational distance between the reference point on the sliding sleeve relative to a fixed point (e.g. fixed point $F_1$) on the outer tubing 120 can correspond to an indexing position of the downhole tool 114. Similarly, magnets 134, 136 while positioned axially along the length of the sliding sleeve 128 in FIG. 4 may in some aspects be positioned radially or circumferentially around the sliding sleeve 128 for determining a rotational distance between a fixed point on the outer tubing 120 and the reference point on the sliding sleeve 128.

Figure 6:
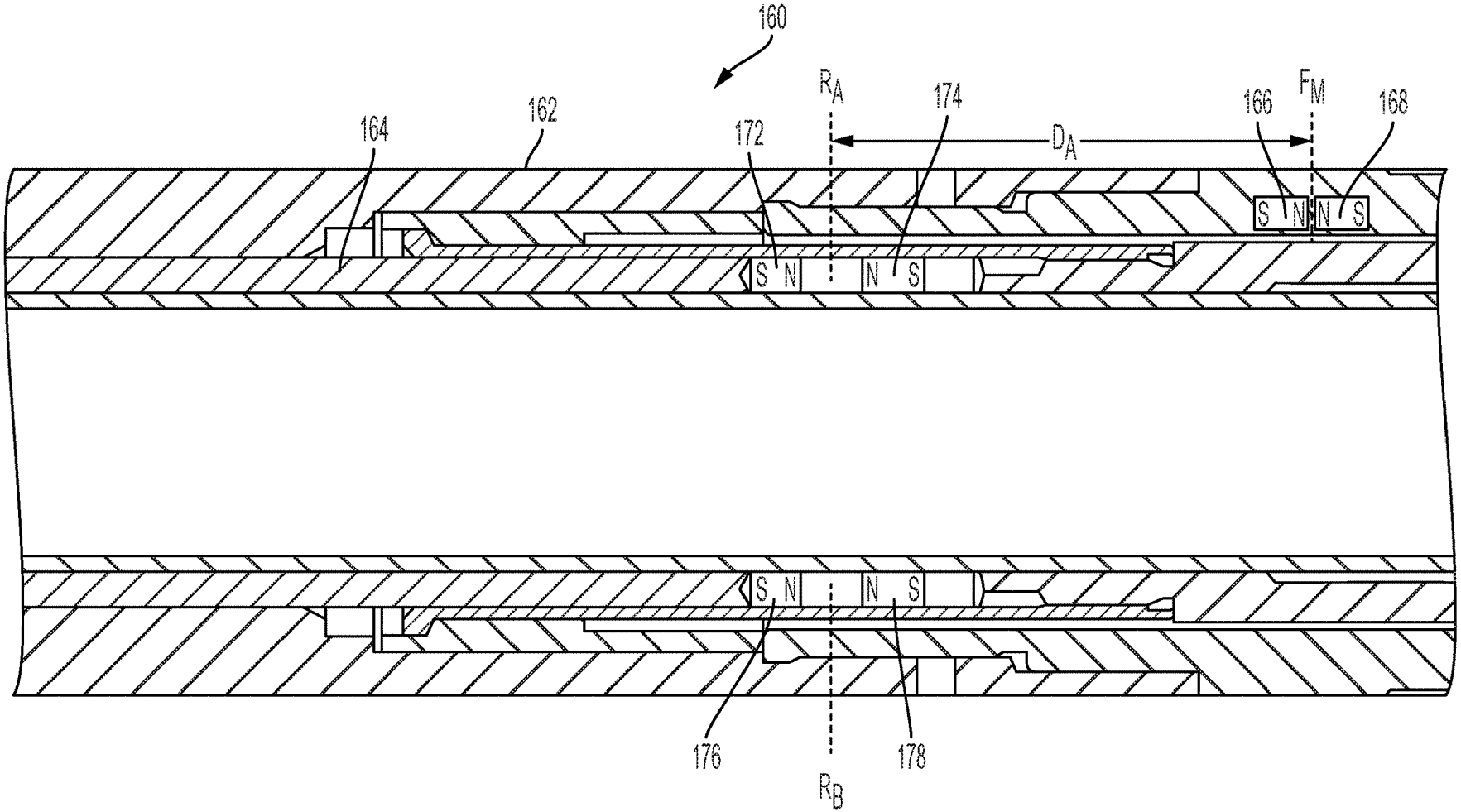
FIG. 6 is a cross-sectional side view of a portion of a downhole tool according to an aspect of the present disclosure.

FIG. 6 depicts an aspect of the present disclosure in which a downhole tool 160 includes an outer tubing 162 and a sliding sleeve 164. The sliding sleeve 164 may move relative to the outer tubing 162 during indexing of the downhole tool 160. A pair of magnets 166, 168 may be positioned on the outer tubing 162 to identify a fixed point of reference $F_M$ on the outer tubing 162. The magnets 166, 168 may be positioned in an opposing orientation as shown in FIG. 6. While FIG. 6 depicts a north pole of magnet 166 adjacent a north pole of magnet 168, in some aspects a south pole of magnet 166 may be positioned adjacent a south pole of magnet 168. The opposing orientation of the magnets 166, 168 in which like poles are adjacent one another (e.g., N-S S-N or S-N N-S) may permit accurate detection of a mid-point (or center point) between the center points of the two magnets 166, 168 that defines the fixed point $F_M$ along the outer tubing 162.

Reference point $R_A$ on the sliding sleeve 164 may correspond to a mid-point between the center of a pair of magnets 172, 174 that are oriented in an opposing orientation such that the mid-point (or reference point $R_A$) is detectable via a magnetometer. Similarly, reference point $R_B$ on the sliding sleeve 164 may correspond to a mid-point between a pair of magnets 176, 178 that are oriented in an opposing orientation such that the mid-point (or reference point $R_B$) is detectable via a magnetometer. A distance $D_A$ between the reference point $R_A$ on the sliding sleeve 164 and the fixed point $F_M$ on the outer tubing 162 may correspond to indexing position (i.e., a number of indexing cycles remaining prior to actuation of the downhole tool 160 or the position in the half cycle, such as being at the top or the bottom of the cycling stroke) of the downhole tool 160. In some aspects, a rotational distance may be measured between the reference $R_B$ and the fixed point $F_M$ (or another fixed point, for example a fixed point at the same longitudinal position as a reference point on the sliding sleeve 164). The rotational position of the sliding sleeve 164 relative to the outer tubing 162 may correspond to the indexing position of the downhole tool 160. Thus, in some aspects, an indexing position of the downhole tool 160 may be determined at a surface of a well system by locating a reference point (e.g. reference point $R_A$ or reference point $R_B$) on the sliding sleeve 164 and comparing that location to a fixed point (e.g. fixed point $F_M$) on the outer tubing 162. In some aspects additional fixed points may be identified on the outer tubing 162, for example by marking, engraving, stamping, identifying via a magnetic field, or otherwise identifying another location on the outer tubing 162.

Figure 7:
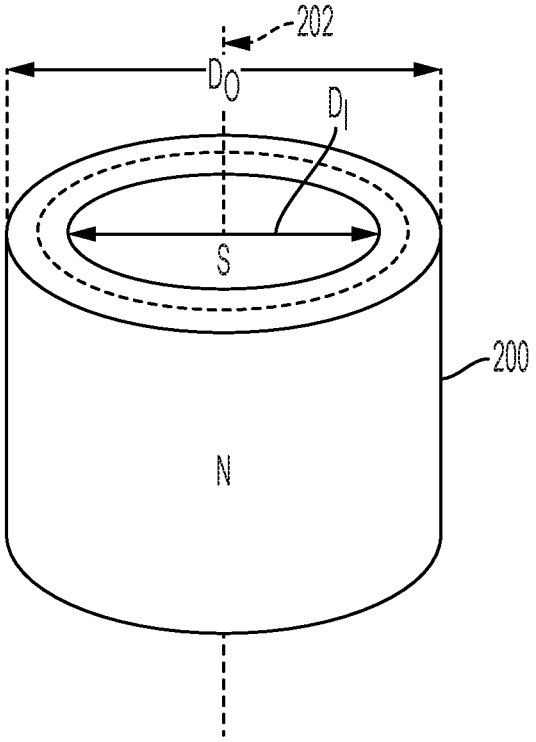
FIG. 7 is an illustration of a magnet having a magnetic field oriented in a radial direction according to an aspect of the present disclosure.

Though the aspects described with reference to FIGS. 2, 4, 5, and 6 describe using a pair of magnets, in some aspects a single magnet having a magnetic field oriented in the radial direction may be used, for example for providing at least two opposing magnetic fields. For example, FIG. 7 depicts a magnet 200 that has a magnetic field in a radial direction. Though the magnet 200 depicts the south pole (S) of the magnet on the inner diameter $D_I$ of the magnet 200 and the north pole (N) of the magnet on the outer diameter $D_O$ of the magnet 200, in some aspects the poles may be reversed such that the south pole of the magnet is on the outer diameter $D_O$ and the north pole is on the inner diameter $D_I$. A mid-point (or center point) 202 can be determined using a magnetometer. The orientation of the poles in magnet 200 provides for two opposing magnetic fields. The mid-point 202 can correspond to a reference point on a sliding sleeve on which the magnet 200 is positioned. Thus, in some aspects a single magnet (e.g. magnet 200) having a magnetic field in a radial direction can be used on a sliding sleeve in place of a pair of magnets for defining a reference point on the sliding sleeve. For example, magnets 130, 132 in some aspects may be replaced with a magnet having a magnetic field in the radial direction (e.g. magnet 200). Similarly, magnets 134, 136 may be replaced with a magnet having a magnetic field in the radial direction (e.g. magnet 200).

Example 1 is a downhole tool for use in a wellbore comprising: an outer tubing comprising: an outer surface, and an inner surface, wherein the inner surface defines an inner region of the outer tubing; and a sliding sleeve positioned within the inner region of the outer tubing, the sliding sleeve being slideable relative to the outer tubing, the sliding sleeve comprising: a first magnet, and a second magnet, wherein the first magnet and second magnet are positioned in an opposing orientation relative to one another, wherein the downhole tool comprises an indexing apparatus for actuating the downhole tool from a surface of the wellbore by applying a pre-determined number of hydraulic pressure signals to the downhole tool.

Example 2 is the downhole tool of example 1, wherein the outer tubing further comprises a fixed point on the outer surface of the outer tubing.

Example 3 is the downhole tool of example 2, wherein the sliding sleeve comprises a reference point that corresponds to a mid-point between the first magnet and the second magnet, and wherein a distance between the reference point on the sliding sleeve and the fixed point on the outer tubing corresponds to an indexing position of the downhole tool.

Example 4 is the downhole tool of examples 1-3, further comprising a fastening feature for securing the first magnet and the second magnet in position relative to one another.

Example 5 is the downhole tool of examples 1-4, wherein the sliding sleeve further comprises a first spacer positioned between the first magnet and the second magnet.

Example 6 is the downhole tool of example 5, wherein the sliding sleeve further comprises a second spacer positioned at an opposite end of the first magnet from the first spacer.

Example 7 is the downhole tool of examples 1-6, wherein the first magnet is positioned axially relative to the second magnet along a length of the downhole tool.

Example 8 is the downhole tool of examples 1-7, wherein a north pole of the first magnet is positioned adjacent a north pole of the second magnet.

Example 9 is the downhole tool of examples 1-8, the sliding sleeve further comprising a third magnet and a fourth magnet, wherein the third magnet and the fourth magnet are positioned in an opposing orientation relative to one another.

Example 10 is the downhole tool of example 2, wherein the fixed point on the outer surface of the outer tubing comprises a mid-point between two opposing magnetic fields.

Example 11 is a downhole tool for use in a wellbore comprising: an outer tubing comprising: an outer surface, and an inner surface, wherein the inner surface defines an inner region of the outer tubing; and a sliding sleeve positioned within the inner region of the outer tubing and slideable relative to the outer tubing, the sliding sleeve comprising: a magnet comprising a magnetic field that extends in a radial direction, wherein the downhole tool comprises an indexing apparatus for actuating the downhole tool from the surface by applying a pre-determined number of hydraulic pressure signals to the downhole tool.

Example 12 is the downhole tool of example 11, wherein the outer tubing further comprises a fixed point on the outer surface of the outer tubing.

Example 13 is the downhole tool of example 12, wherein the sliding sleeve comprises a reference point that corresponds to a mid-point of the magnet and wherein a distance between the reference point on the sliding sleeve and the fixed point on the outer tubing corresponds to an indexing position of the downhole tool.

Example 14 is the downhole tool of example 13, wherein the distance between the reference point on the sliding sleeve and the fixed point on the outer tubing corresponds to a rotational distance between the reference point on the sliding sleeve and the fixed point on the outer tubing.

Example 15 is a method for determining an indexing position of a downhole tool positioned at a surface of a well site: determining a magnetic field along a length of an outer tubing of the downhole tool; identifying a reference point on a sliding sleeve corresponding to a mid-point between two opposing magnetic fields, wherein the sliding sleeve is positioned within an inner region of the outer tubing; and determining a distance between the reference point on the sliding sleeve and a fixed point on the outer tubing of the downhole tool, wherein the distance between the reference point and the fixed point corresponds to an indexing position of the downhole tool.

Example 16 is the method of example 15, wherein the step of determining a magnetic field along a length of an outer tubing of the downhole tool further comprises passing a magnetometer along an outer surface of the outer tubing.

Example 17 is the method of examples 15-16, wherein the step of determining a magnetic field along a length of an outer tubing of the downhole tool further comprises passing a magnetometer within the inner region of the outer tubing.

Example 18 is the method of examples 15-17, wherein the step of identifying a reference point on a sliding sleeve corresponding to a mid-point between two opposing magnetic fields further comprises identifying a mid-point between two magnets positioned in an opposing orientation relative to one another.

Example 19 is the method of examples 15-17, wherein the step of identifying a reference point on a sliding sleeve corresponding to a mid-point between two opposing magnetic fields further comprises identifying a mid-point of a magnet having a magnetic field orientated in a radial direction.

Example 20 is the method of example 15-19, wherein the step of determining a distance between the reference point on the sliding sleeve and a fixed point on the outer tubing of the downhole tool, further comprises determining a distance between the reference point and the fixed point along a longitudinal axis of the downhole tool.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

That which is claimed is:

1. A downhole tool having an indexing apparatus for use in a wellbore comprising:

an outer tubing comprising:
- an outer surface,
- an inner surface, wherein the inner surface defines an inner region of the outer tubing,
- a fixed point on the outer surface of the outer tubing; and a sliding sleeve positioned within the inner region of the outer tubing, the sliding sleeve being slideable relative to the outer tubing, the sliding sleeve comprising:
- a first magnet,
- a second magnet, wherein the first magnet and second magnet are positioned in an opposing orientation relative to one another,
- a reference point that corresponds to a mid-point between the first magnet and the second magnet, wherein a distance between the reference point on the sliding sleeve and the fixed point on the outer tubing corresponds to an indexing position of the indexing apparatus of the downhole tool.

2. The downhole tool of claim 1, further comprising a fastener for securing the first magnet and the second magnet in position relative to one another.

3. The downhole tool of claim 1, wherein the sliding sleeve further comprises a first spacer positioned between the first magnet and the second magnet.

4. The downhole tool of claim 3, wherein the sliding sleeve further comprises a second spacer positioned at an opposite end of the first magnet from the first spacer.

5. The downhole tool of claim 1, wherein the first magnet is positioned axially relative to the second magnet along a length of the downhole tool.

6. The downhole tool of claim 1, wherein a north pole of the first magnet is positioned adjacent a north pole of the second magnet.

7. The downhole tool of claim 1, the sliding sleeve further comprising a third magnet and a fourth magnet, wherein the third magnet and the fourth magnet are positioned in an opposing orientation relative to one another.

8. The downhole tool of claim 1, wherein the fixed point on the outer surface of the outer tubing comprises a mid-point between two opposing magnetic fields.

9. The downhole tool of claim 1, wherein the fixed point at least partially encircles a circumference of the outer tubing.

10. The downhole tool of claim 1, the sliding sleeve further comprising a third magnet and a fourth magnet.

11. A downhole tool having an indexing apparatus for use in a wellbore comprising:

an outer tubing comprising:

an outer surface, an inner surface, wherein the inner surface defines an inner region of the outer tubing, a fixed point on the outer surface of the outer tubing; and a sliding sleeve positioned within the inner region of the outer tubing and slideable relative to the outer tubing, the sliding sleeve comprising:

a magnet comprising a magnetic field that extends in a radial direction, a reference point that corresponds to a mid-point of the magnet and wherein a distance between the reference point on the sliding sleeve and the fixed point on the outer tubing corresponds to an indexing position of the indexing apparatus of the downhole tool.

12. The downhole tool of claim 11, wherein the distance between the reference point on the sliding sleeve and the fixed point on the outer tubing corresponds to a rotational distance between the reference point on the sliding sleeve and the fixed point on the outer tubing.

13. The downhole tool of claim 11, further comprising a fastener for securing the magnet in position.

14. The downhole tool of claim 11, wherein the fixed point at least partially encircles a circumference of the outer tubing.

15. A method for determining an indexing position of a downhole tool positioned at a surface of a well site:

determining a magnetic field along a length of an outer tubing of the downhole tool;

identifying a reference point on a sliding sleeve corresponding to a mid-point between two opposing magnetic fields, wherein the sliding sleeve is positioned within an inner region of the outer tubing; and determining a distance between the reference point on the sliding sleeve and a fixed point on the outer tubing of the downhole tool, wherein the distance between the reference point and the fixed point corresponds to an indexing position of the downhole tool.

16. The method of claim 15, wherein the step of determining a magnetic field along a length of an outer tubing of the downhole tool further comprises passing a magnetometer along an outer surface of the outer tubing.

17. The method of claim 15, wherein the step of determining a magnetic field along a length of an outer tubing of the downhole tool further comprises passing a magnetometer within the inner region of the outer tubing.

18. The method of claim 15, wherein the step of identifying a reference point on a sliding sleeve corresponding to a mid-point between two opposing magnetic fields further comprises identifying a mid-point between two magnets positioned in an opposing orientation relative to one another.

19. The method of claim 15, wherein the step of identifying a reference point on a sliding sleeve corresponding to a mid-point between two opposing magnetic fields further comprises identifying a mid-point of a magnet having a radially oriented magnetic field.

20. The method of claim 15, wherein the step of determining a distance between the reference point on the sliding sleeve and a fixed point on the outer tubing of the downhole tool, further comprises determining a distance between the reference point and the fixed point along a longitudinal axis of the downhole tool.

* * * * *